United States Patent [19]

Alario et al.

[11] Patent Number: 4,583,587

[45] Date of Patent: Apr. 22, 1986

[54] MULTI-LEG HEAT PIPE EVAPORATOR

[75] Inventors: Joseph P. Alario, Hauppauge; Robert A. Haslett, Dix Hills, both of N.Y.

[73] Assignee: The United States of America as represented by the Administrator of the National Aeronautics and Space Administration, Washington, D.C.

[21] Appl. No.: 616,002

[22] Filed: May 31, 1984

[51] Int. Cl.[4] ..... F28D 15/00

[52] U.S. Cl. ..... 165/104.26; 122/366; 165/41; 165/104.14

[58] Field of Search ..... 165/104.26, 104.14; 122/366

[56] References Cited

U.S. PATENT DOCUMENTS

| | | | |
|---|---|---|---|
| 1,962,016 | 6/1934 | Henckell | 165/104.14 |
| 3,734,173 | 5/1973 | Moritz | 165/104.26 |
| 3,971,435 | 7/1976 | Peck | 165/104.26 |
| 4,040,478 | 8/1977 | Pogson et al. | 165/104.26 |
| 4,136,733 | 1/1979 | Asselman et al. | 165/104.26 |
| 4,470,450 | 9/1984 | Bizzell et al. | 165/104.26 |
| 4,470,451 | 9/1984 | Alario et al. | 165/104.26 |
| 4,515,207 | 5/1985 | Alario et al. | 165/104.26 |

*Primary Examiner*—Albert W. Davis, Jr.

*Attorney, Agent, or Firm*—Russell E. Schlorff; John R. Manning; Marvin F. Matthews

[57] ABSTRACT

A monogroove high capacity heat pipe has compact evaporator section 30 formed of a plurality of parallel legs 32 which are in fluid communication with a manifold 36 which is in fluid communication with the condensor section 40 encased in a heat radiating fin 42.

7 Claims, 4 Drawing Figures

MULTI-LEG HEAT PIPE EVAPORATOR

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435-42 U.S.C. 2457).

CROSS REFERENCE TO RELATED APPLICATIONS

The present invention is an improvement to the invention disclosed in U.S. patent application Ser. No. 244,290 (Alario, et al., filed March 16, 1981), now U.S. Pat. No. 4,470,451, issued Sept. 11, 1984 and U.S. patent application Ser. No. 615,505 (Alario, filed May 30, 1984, entitled "Monogroove Heat Pipe Having Insulated Liquid Channel"), now U.S. Pat. No. 4,515,207, issued May 7, 1985.

BACKGROUND OF THE INVENTION

1. Field of the Invention

The present invention relates to heat pipes, and more particularly to a monogroove heat pipe having separate channels for the axial transport of the liquid and vapor phases of the working medium, a multi-leg evaporation section and an artery supported generally concentrically within the liquid channel of the evaporation section for retaining liquid in the channel and assuring liquid feed to the evaporation section during periods of excessive heat transfer thereto.

2. Background

Recent monogroove heat pipe developments set forth in the above mentioned applications have produced high performance heat pipes with tested heat transport performances in excess of 14,000 W-m, and theoretical capacities in excess of 25,000 W-m. These improvements represent an increase in heat transport capacity of better than two orders of magnitude over other currently existing heat pipe designs.

The above applications are directed to continuous extending heat pipes which in certain applications may be over fifty feet in total length. While the condenser section is encompassed by a heat radiating fin, the evaporation section does not need to be so structured. Therefore, it may be advantageous to reduce the length of the evaporation section.

SUMMARY OF THE INVENTION

The present invention facilitates the use and application of a monogroove heat pipe by providing an evaporation section which is compact in area and structurally more compatible with certain heat exchangers or heat input apparatus. More particularly, the evaporation section of a monogroove heat pipe is formed by a series of parallel legs having a liquid and a vapor channel and a communicating capillary slot therebetween as described in the above mentioned applications. The liquid and vapor channels and interconnecting capillary slots of the evaporating section are connected to the condensing section of the heat pipe by a manifold connecting liquid and vapor channels of the parallel evaporation section legs with the corresponding liquid and vapor channels of the condensing section.

DESCRIPTION OF THE PREFERRED EMBODIMENT

Figure 1:
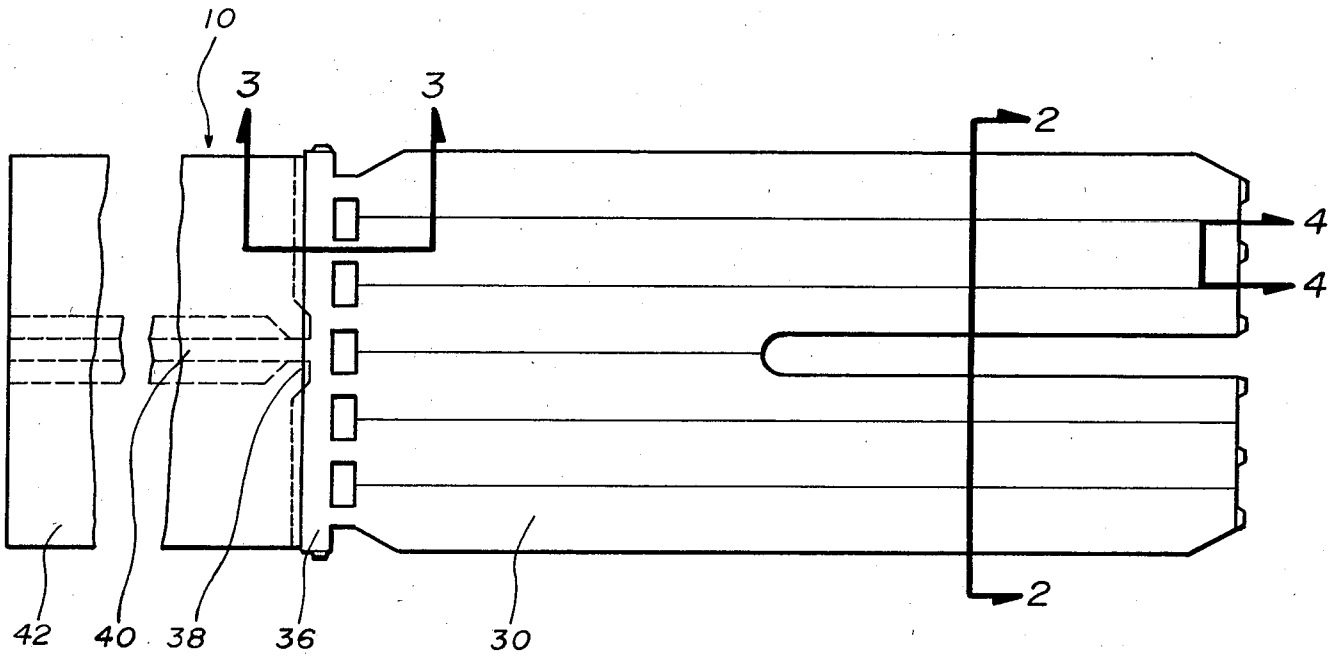
FIG. 1 is a plan view of the monogroove heat pipe assembly with a multi-leg evaporation section.
Figure 2:
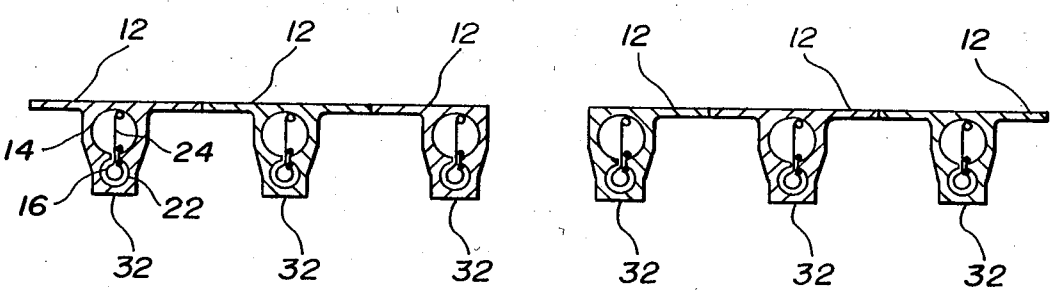
FIG. 2 is a cross sectional view taken along lines 2—2 of FIG. 1
Figure 3:
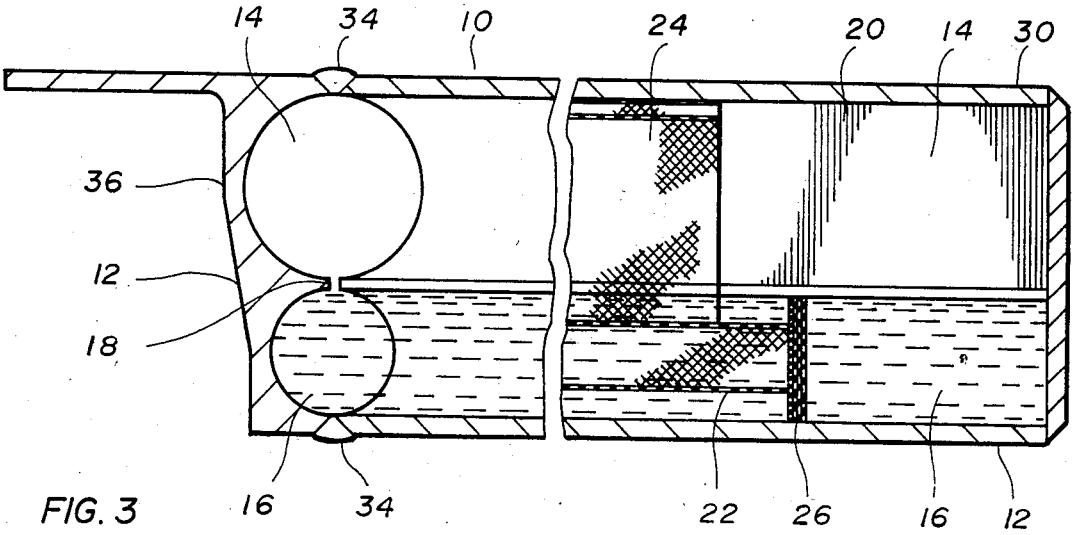
FIG. 3 is a cross sectional view taken along lines 3—3 of FIG. 1
Figure 4:
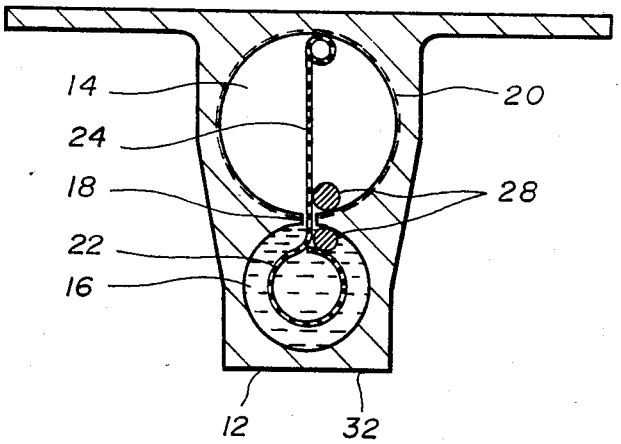
FIG. 4 is a cross sectional view taken along lines 4—4 of FIG. 1

With reference to the drawings, the preferred embodiment of the new and improved monogroove heat pipe having a multi leg evaporation section in accordance with the present invention will now be described.

As previously set forth, the heat pipe 10 of the present invention is an improvement on the heat pipe set forth in U. S. patent application Ser. No. 244,290, filed Mar. 16, 1981, and U.S. patent application Ser. No. 615,505 filed May 30, 1984, both of which are fully incorporated herein by reference.

In order to meet the future heat rejection requirements of large space platforms or space stations, a high-capacity, high-reliability space radiator is required. The high capacity monogroove heat pipe disclosed in above two mentioned patent applications theoretically has a heat transport capacity of 12,700 W-m to 25,400 W-m and is central to the space constructible radiator. The space constructible radiator utilizes replaceable individual heat pipe radiator elements which may be attached to the central heat transport loop of a large space station through a dry interface. A description of the system and test results of the monogroove heat pipe of the present invention is contained AIAA paper 83-1431 (June 1983) entitled "Monogroove Heat Pipe Development for the Space Constructible Radiator System," fully incorporated herein by reference.

The heat pipe 10 is formed of an aluminum extrusion 12 containing two large axial channels—one for vapor 14 and one for liquid 16. A small slot 18 separating the channels 14 and 16 sustains a high capillary pressure difference which, coupled with the small flow resistance of the two separate channels, results in high axial heat transport capacity. High evaporation and condensation film coefficients are provided separately by circumferential grooves 20 machined into the walls of the vapor channel 14 without interfering with the longitudinal heat transport capability of the axial groove.

To reduce superheating, liquid channel 16 was isolated from the evaporator wall by a surrounding vapor annulus. To accomplish this, in the evaporator section of the heat pipe there is a concentric screen mesh artery 22 concentrically located within liquid channel 16, and a bridging wick 24 which provides an alternate feed path between liquid channel 16 and grooves 20 of vapor channel 14. The purpose of screen artery 22 is to retain liquid in the channel and bridging wick to feed the evaporator wall grooves 20 in the event that excessive heat transfer causes boiling and loss of liquid from the surrounding annulus. Should this occur, the annulus will contain slightly superheated vapor which serves to insulate the central screen artery from further liquid loss. The screen artery is sized so that it retains about 90% of the theoretical transport capacity of the original channel. The bridging wick 24 is made from stainless steel screen and provides a parallel feed path between liquid channel 16 and the farthest ends of the vapor channel wall grooves 20. This improves the overall heat transfer coefficient by eliminating local dryout (hot spots) at the primary heat input zone. In order to stabilize the liquid-vapor interface movement and eliminate any resulting pressure fluctuations, a screen plug 26 is placed within the vapor annulus at the entrance of each evaporator leg 12. Longitudinal rods 28—28 properly positions the screen artery 22 and bridging wick 24.

The monogroove heat pipe of the previously referenced applications may be a continuous run, however, to provide for high capacity designs where there is a compact heat exchanger, the heat pipe 10 of the present invention has a multi-leg evaporator section 30. The evaporator 30 is formed of six parallel legs 32 which are configured to interface with a flat plate surface which can be either a fluid heat exchanger or equipment cold plates (not shown). Each leg 32 of evaporator 30 is an extrusion 12 of the monogroove heat pipe which is welded at 34 to a common distribution manifold 36 which is also a section of extrusion 12. The manifold, in turn, is connected by welding at 38 to a single condenser section 40 which is also formed from extrusion 12. A heat radiating fin 42 is attached to the condenser section 40. The liquid and vapor channels within each extrusion 12 are positioned and aligned so that there is a corresponding communication which insures proper liquid and vapor distribution throughout the heat pipe assembly 10. The monogroove design, with its two separate liquid and vapor channels is particularly well suited to the multi-leg evaporator. This invention creates multiple parallel legs for the evaporator while maintaining continuity with the other heat pipe sections. The compact evaporator permits design choices in intergrating the high capacity monogroove heat pipe design into heat transport/rejection systems with diminishing heat transfer capability of the monogroove design.

Although there was some concern about variations in the monogroove slot width due to the fabrication and assembly operations a prototype heat pipe assembly having a compact multi-legged evaporator section (0.3 -m wide by 0.71 -m long) containing six heat pipe tubes in parallel and a 15.2 -m wide double sided radiating fin was tested producing a 1200 W heat transfer rate with ammonia. Full test results are set forth in the AIAA referenced paper.

What is claimed is:

1. A high capacity, sealed, monogroove heat pipe assembly comprising:

an evaporation section formed of a plurality of parallel legs, each leg, containing a liquid channel a vapor channel and a communicating capillary slot therebetween, the vapor channel having circumferentially extending capillary grooves in the wall thereof;

a manifold in fluid communication with the liquid channels and the vapor channels;

a condenser section in fluid communication with the manifold, said condenser section having a single liquid channel and a single vapor channel with a communicating capillary slot therebetween, the vapor channel having circumferentially extending capillary grooves in the wall thereof; and a heat radiating fin encasing the condenser section.

2. The heat pipe assembly set forth in claim 1 in which there is an artery means in the liquid channels of the evaporator section formed by a substantially concentrically positioned mesh screen and there are bridging means for providing an auxiliary liquid flow path from the liquid channel through the capillary slot to the wall of the vapor channel.

3. The heat pipe assembly set forth in claim 2 in which there is a porous plug extending across the end of each liquid channel remote from the condensor for conducting liquid therethrough while preventing vapor from flowing therepast.

4. The heat pipe assembly set forth in claim 1 in which the legs of the evaporator section are co-planar for dry interface with a heat transfer source and means to maintain heat transfer contact.

5. An evaporation section for a monogroove heat pipe comprising: a plurality of parallel legs;

each leg containing a liquid and a vapor channel and a communicating capillary slot therebetween;

a manifold connecting the individual legs and the liquid and vapor channels; and a condenser section having at least one liquid and one vapor channel with a communicating capillary slot therebetween connected to the manifold.

6. A high capacity, sealed, monogroove heat pipe assembly comprising: an evaporation section formed of a plurality of parallel legs, each leg, containing a liquid channel and a vapor channel and a communicating capillary slot therebetween, the vapor channel having circumferentially extending capillary grooves in the wall thereof, artery means in each liquid channel formed by a substantially concentrically positioned mesh screen and bridging means for providing an auxiliary liquid flow path from the liquid channel through the capillary slot to the wall of the vapor channel, and a porous plug extending across the liquid channel adjacent the entrance of each evaporation leg for conducting liquid therethrough while preventing vapor from flowing therepast.

7. The heat pipe assembly set forth in claim 6 in which the legs of the evaporator section are co-planar for dry interface with a heat transfer source and means to maintain heat transfer contact.

* * * * *